United States Patent [19]

King et al.

[11] Patent Number: 4,547,930

[45] Date of Patent: Oct. 22, 1985

[54] HINGE PREPARATION ASSEMBLY FOR A STEEL DOOR

[75] Inventors: Donald L. King, Loveland; Robert O. Ruff; Ernest D. Schwarz, II, both of Cincinnati, all of Ohio

[73] Assignee: American Standard Inc., New York, N.Y.

[21] Appl. No.: 602,028

[22] Filed: Apr. 19, 1984

[51] Int. Cl.[4] ..... E05D 5/00

[52] U.S. Cl. ..... 16/382; 16/254; 16/247; 16/DIG. 29

[58] Field of Search ..... 49/504; 16/382, 221, 16/252, 383, 384, DIG. 29, 247, DIG. 43

[56] References Cited

U.S. PATENT DOCUMENTS

| | | | |
|---|---|---|---|
| 1,323,757 | 12/1919 | Gogay | 16/382 X |
| 1,323,758 | 12/1919 | Gogay | 16/382 X |
| 3,229,323 | 1/1966 | Hensgen | 16/247 |
| 3,274,735 | 9/1966 | Stackhouse | 49/504 |
| 4,034,514 | 7/1977 | Cecil | 49/504 |

OTHER PUBLICATIONS

"Nomenclature for Steel Doors and Steel Door Frames", ©1974.

*Primary Examiner*—Donald R. Schran
*Assistant Examiner*—James Wolfe
*Attorney, Agent, or Firm*—James J. Salerno, Jr.; Robert G. Crooks; John P. Sinnott

[57] ABSTRACT

The invention relates to hinge preparation assembly for mounting in each of the hinge mortises formed in the hinge edge of a steel door. The hinge preparation assembly includes a hinge reinforcement member having a plurality of spaced apart openings including threaded openings for mounting a leaf of a standard weight hinge set thereto. A hinge conversion member is removably mounted to the hinge reinforcement member so that upon its removal, the hinge preparation assembly is converted from a standard weight hinge preparation to a heavy weight hinge preparation, which is capable of mounting a leaf of a heavy weight hinge set thereto without requiring changing the door, modifying the hinge mortises thereof or the hinge preparation assembly.

12 Claims, 14 Drawing Figures

FIG. 6
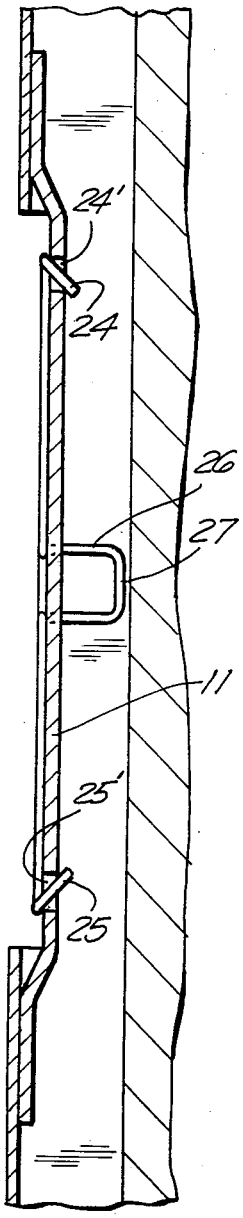
FIG. 7
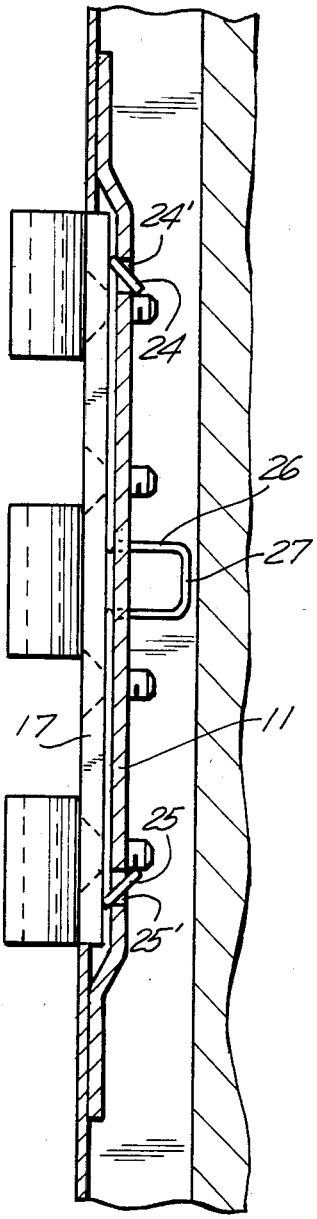
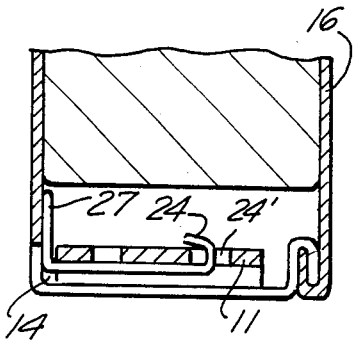
FIG. 8
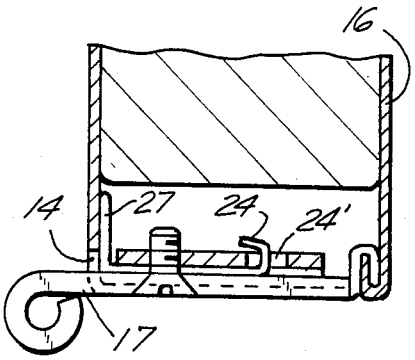
FIG. 9

HINGE PREPARATION ASSEMBLY FOR A STEEL DOOR

FIELD OF THE INVENTION

The present invention relates to a steel door assembly, and more particularly, to a steel door having hinge preparation assemblies adapted to receive either standard or heavy weight hinge sets.

PRIOR ART

In the manufacture of steel doors, the preparation of the hinge cutouts are made during forming of the door. A hinge reinforcement member, in the form of a plate or channel, is generally spot-welded across each hinge cutout of the door. The reinforcement plate has threaded openings which correspond to the openings in the leaf of the hinge set. Door hinge fillers are used as a small removable trim part located between the hinge leaf and door hinge reinforcements and is reversible to accommodate change of door handing. Also, frame plaster guards, generally in the form of a box are mounted behind the hinge and strike reinforcements, to prevent mortar or plaster from filling the threaded mounting holes. Generally, steel doors and steel frames are manufactured to accommodate only a standard weight hinge or only a heavy weight hinge. Therefore, steel doors having standard weight and heavy weight hinge preparation assemblies are separately manufactured and stocked by suppliers. Such procedures add expense to their manufacture and increase inventories for the manufacture as well as delays to the supplier for supplying the customer with both styles of doors.

SUMMARY OF THE INVENTION

It is an object of the invention to provide a multi-use steel door assembly having a hinge conversion means adapted to mount a standard weight or a heavy weight hinge leaf without the necessity of changing or modifying the hinge mortises of the door.

Another object of the invention is to provide means to rapidly convert the hinge preparation assembly of a steel door from a standard weight hinge preparation to a heavy weight hinge preparation without requiring changing the steel door or without modifying the hinge mortises of the steel door.

A further object of the invention is to provide a hinge conversion means removably mounted on the hinge reinforcement plate of the steel door for converting each hinge preparation assembly thereof from either a standard weight to a heavy weight hinge preparation or vice versa.

The invention generally contemplates providing a hinge preparation assembly capable of mounting a leaf of a heavy weight hinge set thereto without requiring changing the mortise preparation. The hinge preparation assembly comprises:

a hinge reinforcement member adapted to be mounted to each hinge cutout section of a steel member and having a plurality of spaced apart openings including spaced apart threaded openings corresponding to the openings of the hinge leaf. A hinge conversion means is mounted to the hinge reinforcement member and is formed having a thickness which is substantially equal to the difference between that of a standard weight hinge leaf and a heavy weight hinge leaf. The hinge conversion means is removably mounted to the hinge reinforcement member so that upon its removal, the hinge preparation assembly is converted from a standard weight hinge preparation to a heavy weight hinge preparation.

BRIEF DESCRIPTION OF THE DRAWINGS

FIG. 6 is a fragmentary, sectional elevational view of the hinge preparation assembly taken along line 6—6 of FIG. 4;

FIG. 7 is a fragmentary, sectional view of the hinge preparation assembly taken along line 7—7 of FIG. 5, showing a standard weight hinge mounted thereon;

FIG. 8 is a fragmentary, sectional view taken along line 8—8 of FIG. 4;

FIG. 9 is a fragmentary, sectional view taken along the line 9—9 of FIG. 5;

DETAILED DESCRIPTION OF THE PREFERRED EMBODIMENTS

Figure 3:
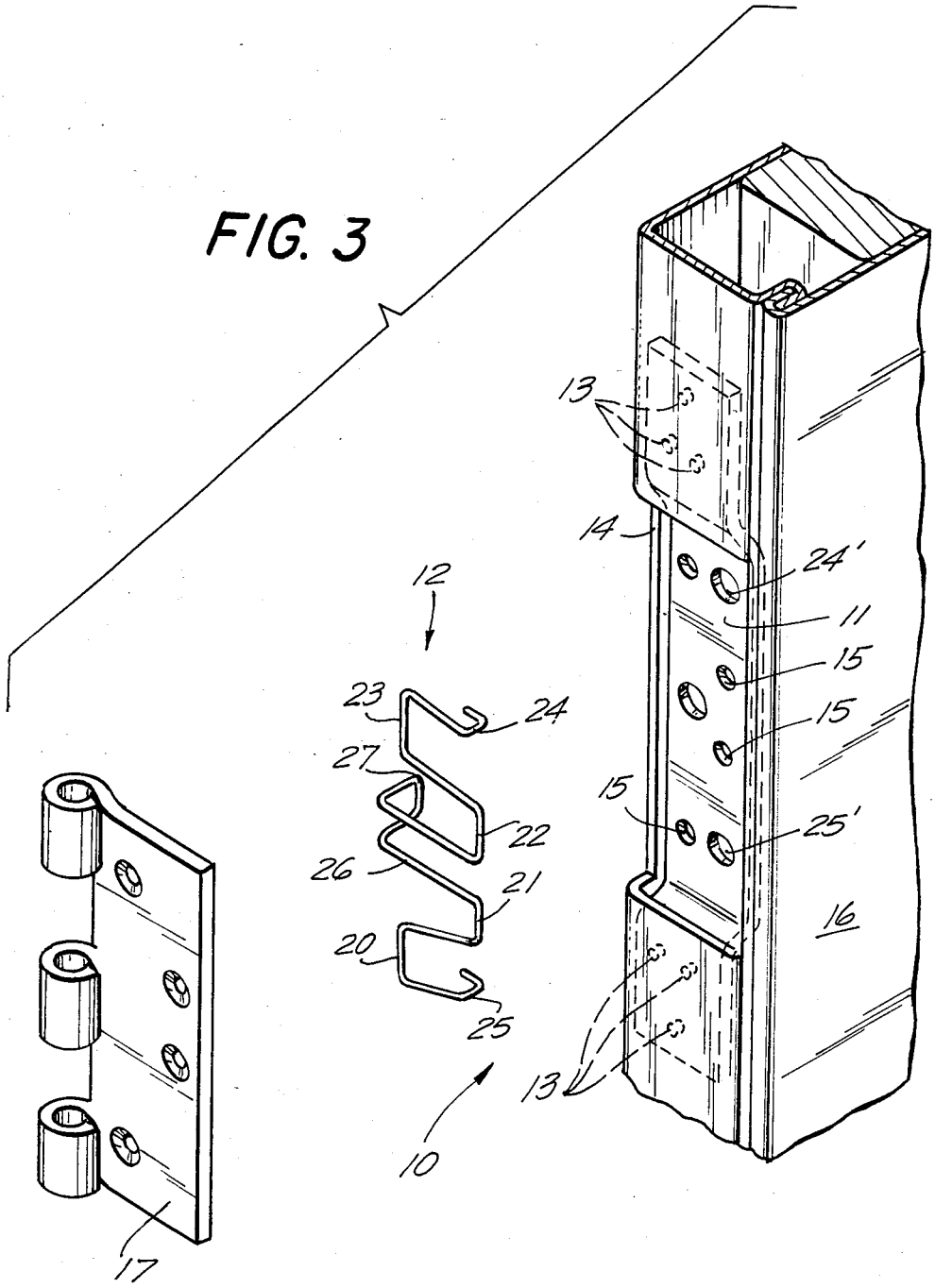
FIG. 3 is an exploded view, in perspective, of a section of a steel door, showing the hinge preparation assembly, including the hinge conversion means and hinge leaf for mounting to the door hinge reinforcement plate.
Figure 4:
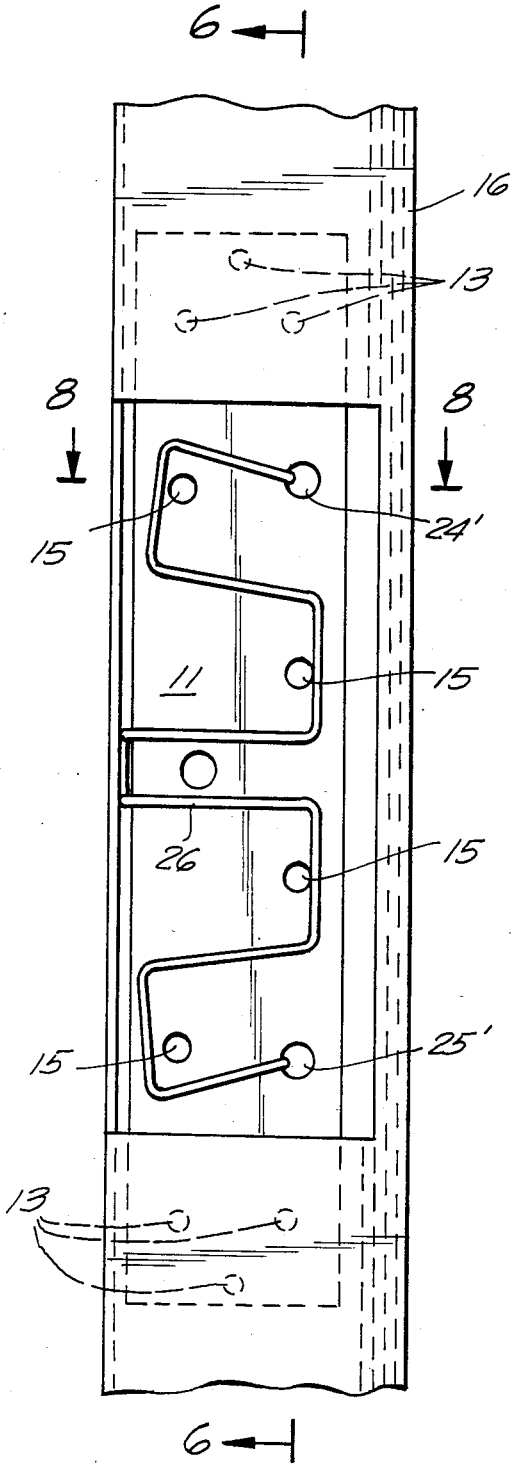
FIG. 4 is a fragmentary elevational view of door hinge preparation assembly showing the hinge conversion means fully assembled and prior to mounting a standard weight hinge leaf thereon.
Figure 5:
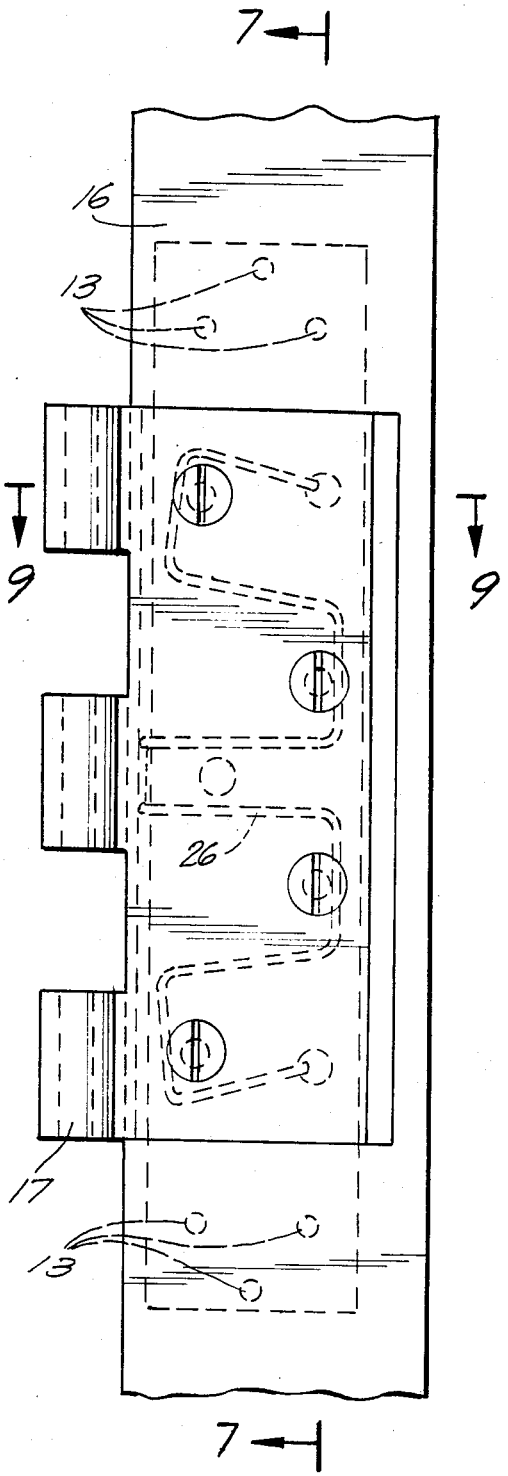
FIG. 5 is a view similar to FIG. 4, but with the standard weight hinge leaf mounted to the hinge preparation of the door.

In the drawings, FIGS. 1–9 illustrate one form of a hinge conversion means 12 of hinge preparation assembly 10. Hinge preparation assembly 10 is shown mounted to the hinge cutout 14 of a steel door 16. Hinge conversion means 12 is mounted to hinge reinforcement plate 11 as by spot welding at 13. Thereafter the door 16 is mounted to hinge jamb 9 via hinge set 3. Hinge reinforcement plate 11 is formed having spaced threaded openings 15 which correspond to openings in hinge leaf or plate 17. Hinge conversion means 12 is formed from a continuous metal wire having plurality of "U" shaped arms 20, 21, 22, 23 which encircle each threaded opening 15 of hinge reinforcement plate 11. Hinge conversion means 12 is mounted to hinge reinforcement plate 11 by latch elements 24, 25 that are anchored in pilot holes 24', 25' therein. Latch elements 24, 25 are "J" shaped with the hook section of the "J" formed normal to the plane of hinge conversion means 12 as illustrated in FIG. 3. Also, "U" shaped arm 26 is formed between arms 20, 23 and is bent at its closed end 27 normal to the plane of the arms 20, 21, 22 and 23 in the direction of "J" shaped hook sections 24, 25. Closed end 27 latches hinge conversion means 12 to hinge reinforcement plate 11 as shown in FIGS. 4 and 6.

Figure 1:
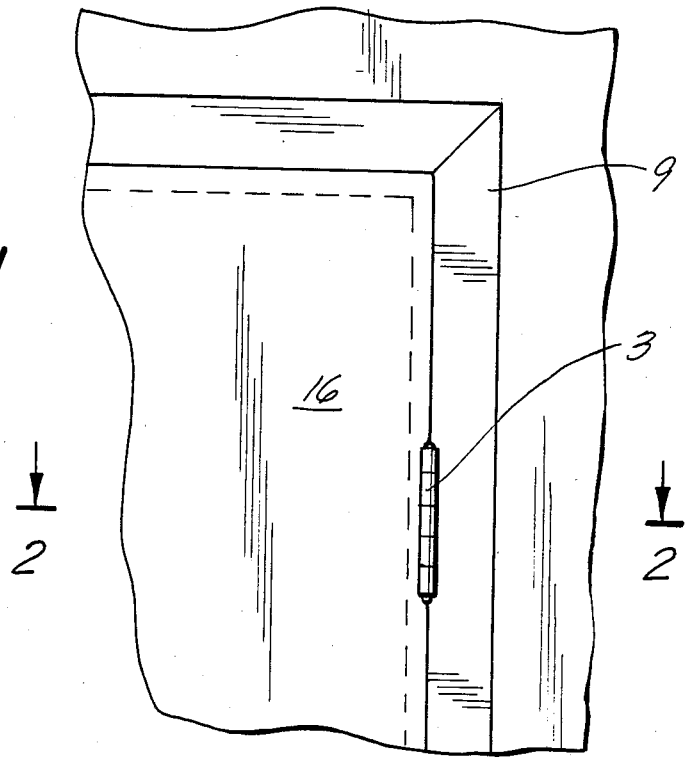
FIG. 1 is a fragmentary, elevational, plan view of a steel door and frame made in accordance with the present invention.
Figure 2:
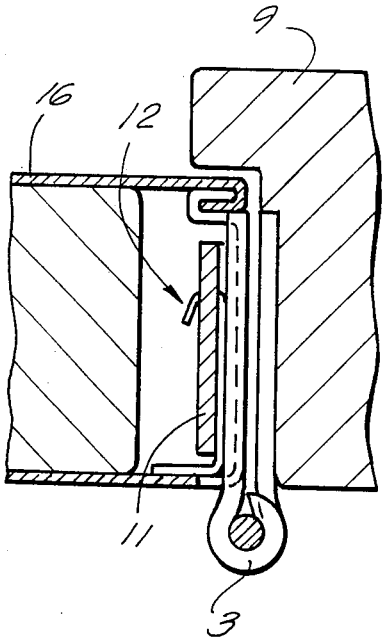
FIG. 2 is a sectional view taken along the line 2—2 of FIG. 1.
Figure 10:
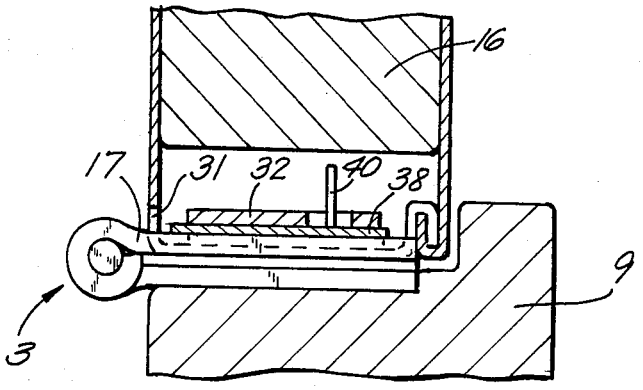
FIG. 10 is a fragmentary, sectional view of a jamb and steel door assembly of another form of the invention for converting the hinge preparation assembly form a standard weight hinge preparation to a heavy weight hinge preparation.
Figure 11:
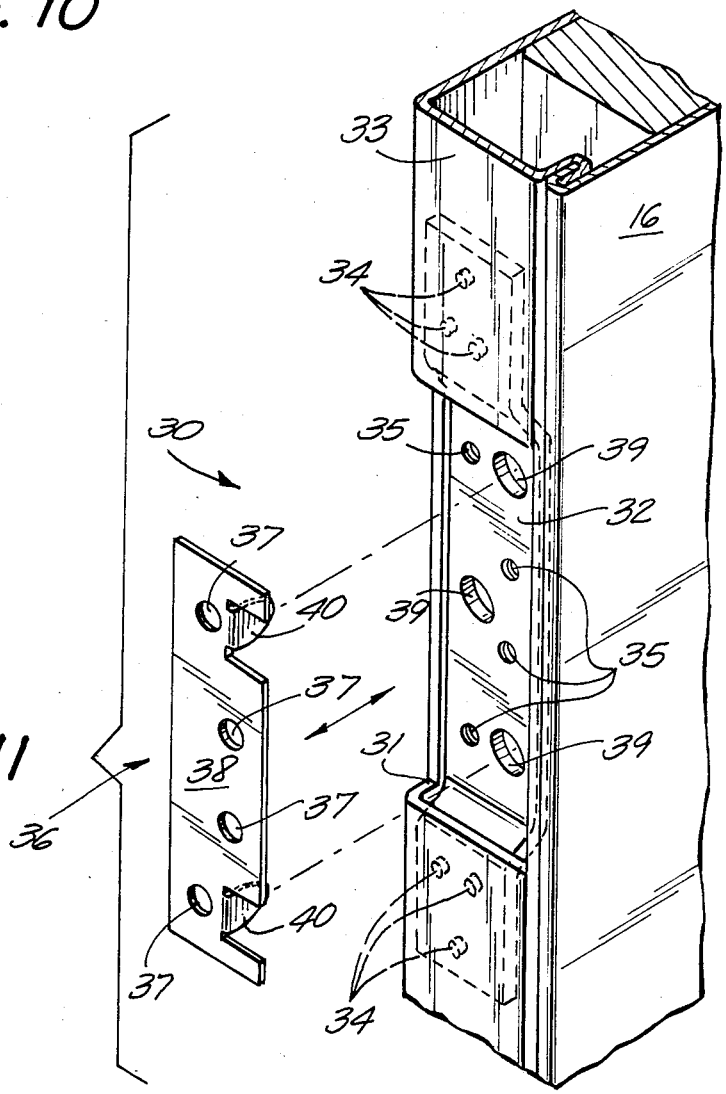
FIG. 11 is a fragmentary, exploded view in elevation of the hinge reinforcement plate mounted to the hinge cut-out of a steel door in which the hinge conversion means either is mounted to or removed from the hinge preparation plate.

FIG. 10 is a sectional view of steel door 16 and door jamb 9 of FIG. 1 of another form of the invention for converting a hinge preparation assembly from a standard weight hinge to a heavy weight hinge preparation. It should be noted that door jamb 9 may be made of metal or wood. Steel door 16 is mounted on door jamb 9 on double leaf hinges 3. The hinge preparation assembly 30 includes a hinge reinforcement plate 32 and hinge conversion means 36 shown most clearly in FIG. 11. In FIG. 11, hinge conversion means 36 is depicted as either being adapted to be fixed in place on hinge reinforcement plate 32 or being removed therefrom to convert the hinge preparation assembly 30 from a standard weight hinge preparation to a heavy weight hinge preparation, whereby a standard weight steel door may be replaced by a steel door of greater weight, not shown, which requires a heavy weight hinge set, not shown.

Hinge reinforcement plate 32 is positioned across the hinged cut-out 31 of hinge edge 33 of door 16. The hinge reinforcement member 32 is spot welded to the hinge door edge 33 at the projection weld dimples 34. A plurality of threaded openings 35 are spaced in a similar pattern to correspond to the openings in the door hinge plate or leaf 17 of FIG. 3.

Figure 12:
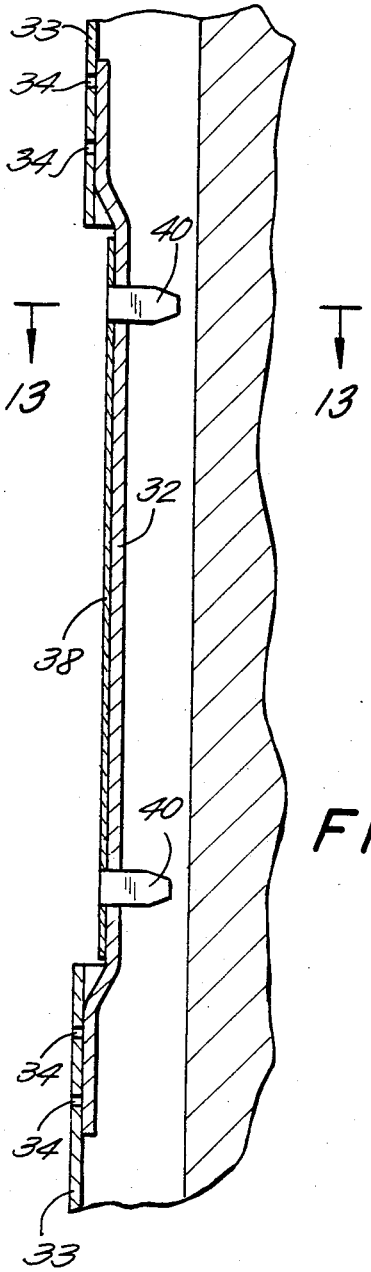
FIG. 12 is a fragmentary sectional in elevation view of a steel door showing the hinge conversion means of FIG. 11 mounted to the hinge preparation plate.
Figure 13:
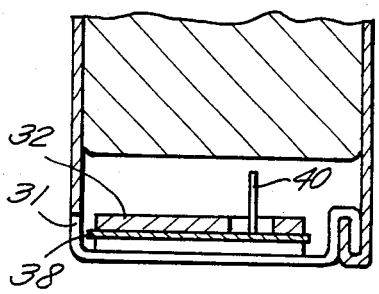
FIG. 13 is a sectional view in elevation taken along lines 13—13 of FIG. 12.
Figure 14:
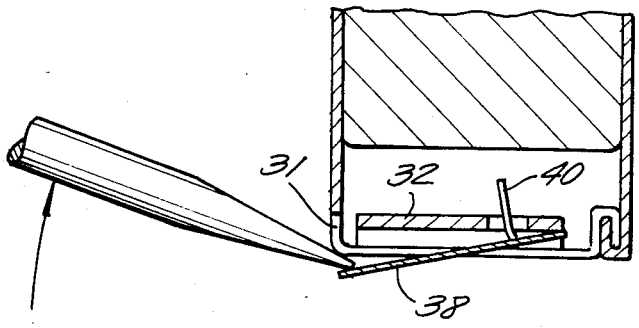
FIG. 14 is a view similar to FIG. 13 showing the removal of the hinge conversion means.

Door hinge conversion means 36 is generally a rectangular, flat metal plate 38, having a plurality of spaced openings 37, which correspond to spaced, threaded openings 35 of hinge reinforcement plate 32. Also integrally formed on plate 38 are depending spaced tabs 40. Tabs 40 are longitudinally aligned and correspond to longitudinally aligned, spaced openings 39 of reinforcement plate 32, the diameters of which, are slightly smaller than the width of tabs 40 so as to provide a friction or pressed fit when hinge conversion means 36 is mounted to reinforcement plate 32, shown in FIG. 12. To convert hinge preparation assembly 30 from a standard to a heavy weight hinge preparation, hinge conversion means 36 is pried upward and is removed as depicted in FIG. 14.

In manufacturing the hinge door edge 33, the cutout for each hinge preparation assembly is cut to a depth of 0.180 inch. The depth of each hinge cutout corresponds to the thickness of a heavy duty hinge leaf. The diameter or the thickness of the metal that is used for making either hinge conversion means 12, 36 has a thickness of 0.0478 inch which is equal to the difference in thickness between a heavy weight hinge leaf and a standard weight hinge leaf.

It can be seen from the foregoing, that many changes and modifications can be made in the shape, thickness, and design of the hinge conversion means of the present invention. For example, the door hinge conversion means of FIGS. 1–9 may be made in two segments or made of a flat metal wire. Also, the hinge conversion means of FIGS. 1–16 may be used as the hinge jamb conversion means when flowable materials which may clog the threaded openings in the hinge reinforcement member are not used to mount the hinge jamb. Likewise, the hinge jam conversion means 12 may be used in place of the door hinge conversion means 36. The relative size of each hinge preparation assembly design and depth of mortise preparations may vary without departing from the invention herein. Also hinge conversion means 12, 36 while illustrated as being made of metal, it is obvious that a suitably formed plastic or fibrous material may be used.

It is claimed:

1. A hinge preparation assembly capable of mounting a leaf of a standard weight hinge set or a heavy weight hinge set thereto without requiring changing the depth of a cutout section of a steel member, said hinge preparation assembly comprising:

a hinge reinforcement member mounted to said each hinge cutout section of the steel member, whose depth is equal to the thickness of a heavy weight hinge leaf, said hinge reinforcement member having a plurality of spaced apart openings, including spaced apart threaded openings corresponding to the openings of said hinge leaf and a;

said hinge conversion means, shaped in the form of a unitary member, and having latch means, said latch means being coupled to at least one of said plurality of spaced apart openings in said reinforcement member; and said unitary member having a thickness which is substantially equal to the difference between that of the standard weight hinge leaf and the heavy weight hinge leaf.

2. The hinge preparation assembly, in accordance with claim 1, wherein said unitary member is a generally rectangular plate having at least one depending finger which is disposed in one of said spaced apart openings to provide a press fit to releasably mount said unitary member to said hinge reinforcement member.

3. The hinge preparation assembly, in accordance with claim 1, wherein said hinge conversion means is a continuous metal wire having a plurality of U-shaped arms formed between the ends thereof, and U-shaped arms arranged and constructed to encircle each of said threaded openings formed in said hinge reinforcement member.

4. The hinge preparation assembly, in accordance with claim 3, wherein said continuous metal wire includes latch means formed at each end thereof, each of said latch means being hook shaped and formed normal to the plane of said U-shaped arms, each hook shaped member being mounted in one of said plurality of spaced apart openings formed in said reinforcement member and a U-shaped member formed between each end thereof and having its closed end section bent normal to the plane of said U-shaped arms, said bent section forming a latch to releasably mount said hinge conversion means to said hinge reinforcement member.

5. A steel door comprising:

a pair of opposed face panels, a lock edge, a hinge edge, and top and bottom edges, said hinge edge having a plurality of vertically spaced and aligned hinge cutouts formed therein, each cutout section having a depth equal to the thickness of a heavy weight hinge leaf;

a hinge preparation assembly, including a hinge reinforcement member and a hinge conversion means;

said hinge reinforcement member mounted across each of said hinge cutout sections and having a plurality of spaced apart openings, including threaded openings for mounting a leaf of a standard weight hinge set or a heavy weight hinge set thereto;

said hinge conversion means removably mounted to said reinforcement member and being in the form of a unitary member, having at least one latch means coupled to at least one of said plurality of spaced apart openings in said reinforcement member; and said unitary member having a thickness which is substantially equal to the difference between that of the standard weight hinge leaf and the heavy weight hinge leaf.

6. The steel door, in accordance with claim 5, wherein said unitary member is a generally rectangular plate, having at least one depending finger, which is disposed in one of said spaced apart openings to provide a press fit to releasably mount said unitary member to said hinge reinforcement member.

7. The steel door, in accordance with claim 5, wherein said hinge conversion means is a continuous metal wire having a plurality of U-shaped arms formed between the ends thereof, said U-shaped arms arranged and constructed to encircle each of said threaded openings formed in said hinge reinforcement member.

8. The steel door, in accordance with claim 7, wherein said continuous metal wire includes latch means formed at each end thereof, each of said latch means being hook shaped and formed normal to the plane of said U-shaped arms, each hook shaped member being mounted in one of said plurality of spaced apart openings formed in said reinforcement member and a U-shaped member formed between each end thereof and having its closed end section bent normal to the plane of said continuous metal wire, said bent section forming a latch to releasably mount said hinge conversion means to said hinge reinforcement member.

9. A hinge conversion means adapted to be removably mounted to a hinge reinforcement member having a plurality of spaced apart openings, including spaced apart threaded openings corresponding to the openings in a hinge leaf, said hinge conversion means and said hinge reinforcement member forming a hinge preparation assembly capable of replacing a leaf of a standard weight hinge set for a leaf of a heavy weight hinge set without requiring changing the depth of the hinge cutout opening of a steel member comprising:

said hinge conversion means being in the form of a unitary member having at least one latch means for coupling to an opening formed in said hinge reinforcement member;

said hinge conversion means having a thickness which is substantially equal to the difference between that of said standard weight hinge leaf and said heavy weight hinge leaf.

10. The hinge conversion means, in accordance with claim 9 is a generally rectangular plate having at least one depending finger for positioning in said opening of said reinforcement member to provide a press fit to releasably mount said hinge conversion means thereto.

11. The hinge conversion means, in accordance with claim 9, is a continuous metal wire having a plurality of U-shaped arms formed between the ends thereof, said U-shaped arms arranged and constructed to encircle each of said threaded openings formed in said hinge reinforcement member.

12. The hinge conversion means, in accordance with claim 11, wherein said continuous metal wire includes latch means formed at each end thereof, each of said latch means being hook shaped and formed normal to the plane of said U-shaped arms, each hook shaped member being releasably mounted in one of said plurality of spaced apart openings formed in said reinforcement member and a U-shaped member formed in each end thereof and having its closed end section bent normal to the plane of said U-shaped arms, said bent section forming a latch to releasably mount said hinge conversion means to said reinforcement member.

* * * * *